US007018019B2

(12) United States Patent
Kim

(10) Patent No.: US 7,018,019 B2
(45) Date of Patent: Mar. 28, 2006

(54) INK-JET PRINTHEAD AND METHOD FOR MANUFACTURING THE SAME

(75) Inventor: Yun-gi Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 75 days.

(21) Appl. No.: 10/690,820

(22) Filed: Oct. 23, 2003

(65) Prior Publication Data

US 2004/0135850 A1 Jul. 15, 2004

(30) Foreign Application Priority Data

Dec. 20, 2002 (KR) ..... 10-2002-0081863

(51) Int. Cl.
*B41J 2/05* (2006.01)

(52) U.S. Cl. ..... 347/62; 347/56

(58) Field of Classification Search ..... 347/56, 347/61–65, 67, 57–59, 20
See application file for complete search history.

(56) References Cited

U.S. PATENT DOCUMENTS 4,990,939 A * 2/1991 Sekiya et al. ..... 347/62
6,224,194 B1 * 5/2001 Kohno et al. ..... 347/56
6,293,654 B1 * 9/2001 Pidwerbecki ..... 347/64
6,578,951 B1 * 6/2003 Ozaki et al. ..... 347/58

* cited by examiner

*Primary Examiner*—Juanita D. Stephens
(74) *Attorney, Agent, or Firm*—Staas & Halsey LLP

(57) ABSTRACT

An ink-jet printhead, and a method for manufacturing the same. The printhead includes a substrate, a first insulating layer on the surface of the substrate, first and second conductors on the first insulating layer separated from each other, a heater including conductor connection layers for electrically connecting the first and second conductors to each other and between the first and second conductors. A second insulating layer is between the first and second conductors and between the conductor connection layers, and a barrier wall is provided on the substrate and defines an ink chamber filled with ink to be ejected. A nozzle plate is provided on the barrier wall, and forms upper walls of the ink chamber and in which nozzles, through which ink filled in the ink chamber is ejected, are formed.

11 Claims, 9 Drawing Sheets

INK-JET PRINTHEAD AND METHOD FOR MANUFACTURING THE SAME

CROSS-REFERENCE TO RELATED APPLICATION

This application claims the benefit of Korean Patent Application No. 2002-81863, filed on Dec. 20, 2002, in the Korean Intellectual Property Office, the disclosure of which is incorporated herein by reference.

BACKGROUND OF THE INVENTION

1. Field of the Invention

The present invention relates to an ink-jet printhead and a method for manufacturing the same, and more particularly, to an ink-jet printhead having an improved structure in which a heater is formed by connecting conductors with a plurality of conductor connection layers, and a method for manufacturing the same.

2. Description of the Related Art

In general, ink-jet printheads are devices for printing a predetermined color image by ejecting small volumes of droplets of printing ink at desired positions on a recording sheet. According to the ink ejection mechanism, these ink-jet printheads are divided into ink-jet printheads using a thermal driving method, ejecting ink droplets by the expansion force of bubbles generated in ink by a heat source, and ink-jet printheads using a piezoelectric driving method, ejecting ink droplets by the pressure applied to ink due to the deformation of a piezoelectric body.

Hereinafter, the ink ejection mechanism in the thermal ink-jet printheads will be described in greater detail. When a pulse current flows through a heater formed of a resistance heating material, heat is generated in the heater, and ink adjacent to the heater is heated to about 300° C. At such a temperature, the ink boils, and bubbles generated in the ink, expand, and apply pressure to an inside of an ink chamber filled with ink. As a result, ink in the vicinity of a nozzle is ejected in droplets through nozzles to the ink chamber.

FIG. 1 is a cross-sectional view illustrating a vertical structure of a conventional ink-jet printhead disclosed in U.S. Pat. No. 6,293,654. Referring to FIG. 1, the conventional ink-jet printhead includes a base plate 10 formed by a plurality of material layers stacked on a substrate 11, a barrier wall 20 formed on the base plate 10 and defining an ink chamber 22, and a nozzle plate 30 stacked on the barrier wall 20. Ink is filled in the ink chamber 22, and a heater 13 heating ink and generating bubbles, is installed under the ink chamber 22. The ink chamber 22 is connected to an ink passage (not shown) forming a path supplying ink to an inside of the ink chamber 22. A plurality of nozzles 32, through which ink is ejected, are in the nozzle plate 30 in correspondence with the ink chamber 22.

The vertical structure of the ink-jet printhead described above is described below in greater detail.

An insulating layer 12, for insulation between the heater 13 and the substrate 11, is on the substrate 12, formed of silicon. The insulating layer 12 is formed by depositing a silicon oxide layer on the substrate 11. The heater 13, heating ink in the ink chamber 22, and generating bubbles, is formed on the insulating layer 12. The heater 13 is formed, for example, by depositing thin-film tantalum nitride (TaN) or thin-film tantalum-aluminum (TaAl) on the insulating layer 12. A conductor 14, applying a current to the heater 13, is formed on the heater 13. The conductor 14 is made of aluminum (Al) or an aluminum (Al) alloy, for example. The conductor 14 is formed by depositing Al on the heater 13 to a predetermined thickness, and patterning Al in a predetermined shape.

A passivation layer 15, for passivating the heater 13 and the conductor 14, is formed on the heater 13 and the conductor 14. The passivation layer 15 prevents the heater 13 and the conductor 14 from oxidizing, or directly contacting, ink, and is formed by depositing a silicon nitride layer. In addition, an anti-cavitation layer 16, on which the ink chamber 22 is to be formed, is formed on the passivation layer 15. The top surface of the anti-cavitation layer 16 forms the bottom surface of the ink chamber 22, thereby preventing the heater 13 from damage due to a high atmospheric pressure generated when bubbles in the ink chamber 22 are expelled. The anti-cavitation layer 16 is usually made of thin-film tantalum (Ta).

The barrier wall 20, forming the ink chamber 22, is stacked on the base plate 10 formed of a plurality of material layers stacked on the substrate 11. The barrier wall 20 is formed by coating a photosensitive polymer on the base plate 10 by lamination, including heating, pressing, and squeezing, and by patterning the photosensitive polymer. In this case, the coating thickness of the photosensitive polymer depends on the height of the ink chamber 22 required in a volume of ejected ink droplets.

The nozzle plate 30, in which the nozzles 32 are formed, is stacked on the barrier wall 20. The nozzle plate 30 is made of polyimide, or nickel, and attached onto the barrier wall 20 using adhesion of the photosensitive polymer forming the barrier wall 20.

However, in the ink-jet printhead having the above structure, the heater 14, for generating a thermal energy, is made of a metallic material having a high resistance of about 30 ohm/square. On the other hand, the conductor 14 applying current to the heater 13 is made of a metallic material having resistance much lower than 30 ohm/square. Thus, in the ink-jet printhead described above, the conductor 14 and the heater 13 cannot be made of the same metallic material.

SUMMARY OF THE INVENTION

The present invention provides an ink-jet printhead having an improved structure with a heater formed by connecting conductors with a plurality of conductor connection layers without providing additional resistance material, and a method for manufacturing the same.

According to an aspect of the present invention, an ink-jet printhead is provided including a substrate, a first insulating layer formed on the surface of the substrate, first and second conductors formed on the first insulating layer, separated from each other, and a heater including a plurality of conductor connection layers electrically connecting the first and second conductors to each other and formed between the first and second conductors. A second insulating layer is formed between the first and second conductors and between the plurality of conductor connection layers, and a barrier wall, on the substrate, defines an ink chamber, filled with ink to be ejected. A nozzle plate is provided on the barrier wall, forming upper walls of the ink chamber and in which nozzles through which ink filled in the ink chamber is ejected are formed.

An interface is formed in at least one of the first and second connection portions where each of the first and second conductors is connected to the conductor connection layers. The conductor connection layers extend from one of the first and second conductors, or are formed of a material of Ti, TiN, Ta, or TaN. The printhead further includes a passivation layer formed on an entire surface of the substrate covering the first and second conductors, and an anti-cavitation layer formed on the passivation layer.

According to another aspect of the present invention, a method for manufacturing an ink-jet printhead is provided. The method includes forming a first insulating layer on the surface of a substrate, forming a first conductor on the first insulating layer, forming a second insulating layer on the first insulating layer and the first conductor, patterning the second insulating layer, and forming a plurality of via holes through which the first conductor is exposed. The method further includes forming a plurality of conductor connection layers and a second conductor on the via holes and the second insulating layer, forming a passivation layer on an entire surface of the substrate to cover the first and second conductors, forming an anti-cavitation layer on the passivation layer, forming a barrier wall which defines an ink chamber, on the substrate, and forming a nozzle plate, in which nozzles are formed, on the barrier wall.

Forming a plurality of conductor connection layers and a second conductor includes depositing a predetermined metallic material on the via holes and the second insulating layer, patterning the predetermined metallic material, and simultaneously forming the plurality of conductor connection layers and the second conductor.

In addition, the forming of a plurality of conductor connection layers and a second conductor includes depositing a predetermined material on the via holes, dry etching the predetermined material, and forming the plurality of conductor connection layers, and forming the second conductor on the second insulating layer and the conductor connection layers. The predetermined material is one of Ti, TiN, Ta, or TaN.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE INVENTION

Figure 1:
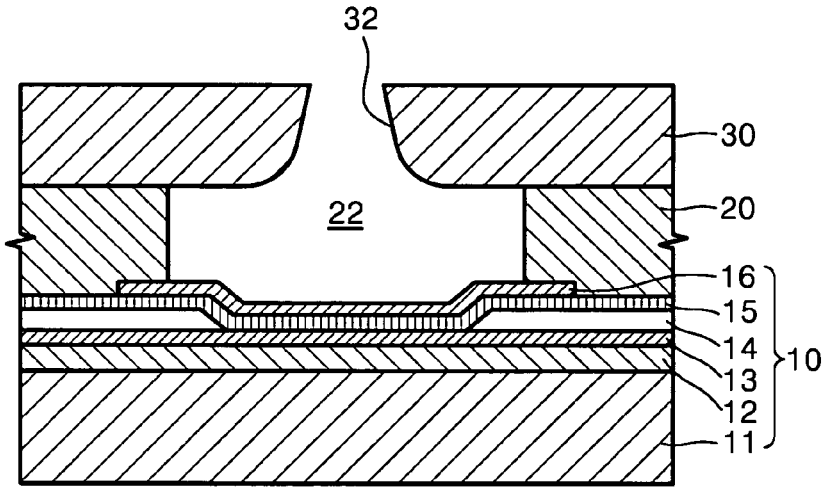
FIG. 1 (PRIOR ART)
FIG. 1 is a cross-sectional view illustrating a structure of a conventional ink-jet printhead.

Reference will now be made in detail to the embodiments of the present invention, examples of which are illustrated in the accompanying drawings, wherein like reference numerals refer to the like elements throughout. The embodiments are described below to explain the present invention by referring to the figures.

This invention may, however, be embodied in many different forms and should not be construed as being limited to the embodiments set forth herein. The size and thickness of an element may be exaggerated in the drawings for clarity of explanation. It will be understood by those skilled in the art that when a layer is described as being "on" another layer or "on" a substrate, it can be directly on the other layer or on the substrate, or intervening layers may also be present.

Figure 2:
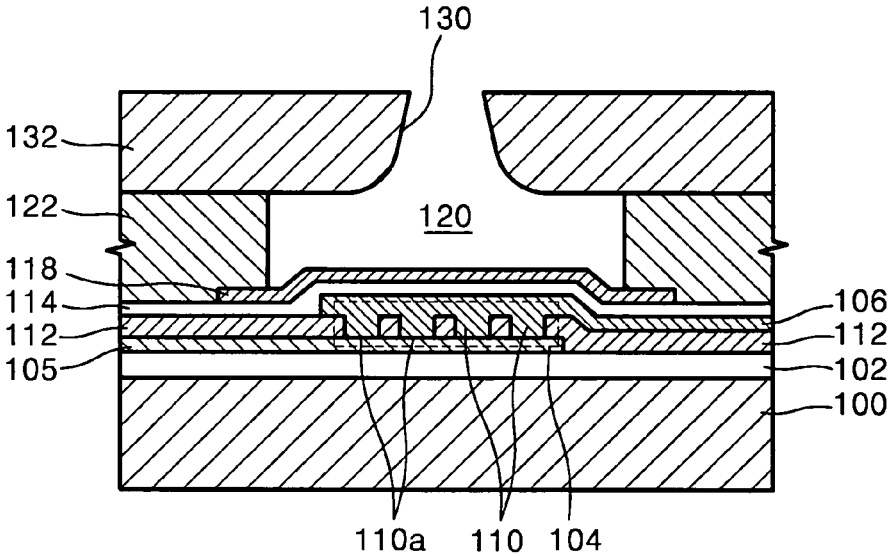
FIG. 2 is a cross-sectional view illustrating a structure of an ink-jet printhead according to an embodiment of the present invention.
Figure 3:
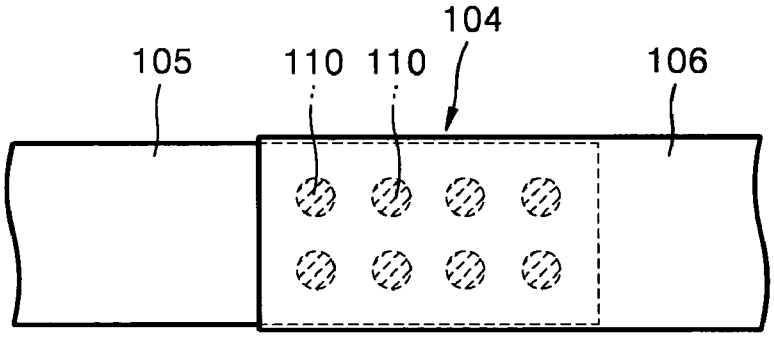
FIG. 3 is a schematic plan view illustrating a heater shown in FIG. 2.

FIG. 2 is a cross-sectional view illustrating a structure of an ink-jet printhead according to an embodiment of the present invention, and FIG. 3 is a schematic, plan view illustrating the heater shown in FIG. 2. Although only a one ink-jet printhead is shown, in an ink-jet printhead manufactured in a chip state, a plurality of ink chambers and a plurality of nozzles are arranged in one, two, three, or more, rows so as to improve printing resolution.

Referring to FIG. 2, a first insulating layer 102, for insulation between a first conductor 105 and a substrate 100, is formed on the surface of the substrate 100 formed of silicon. Meanwhile, the first insulating layer 102 also serves as an adiabatic layer, preventing heat generated in a heater 104 from conducting toward the substrate 100. The first insulating layer 102 is generally formed of silicon oxide or silicon nitride (SiN).

The first conductor 105 and a second conductor 106 are formed on the first insulating layer 102 so as to be separated from each other by a second insulating layer 112. The first and second conductors 105 and 106 are made of metal having a high conductivity, such as aluminum (Al) or aluminum alloy.

The heater 104, including a plurality of conductor connection layers 110 electrically connecting the first and second conductors 105 and 106 to each other, is provided between the first and second conductors 105 and 106. The conductor connection layers 110 extend from the second conductor 106, and are connected to the first conductor 105. Thus, an interface is formed in each of first connection portions 110*a* where the first conductor 105 is connected to the conductor connection layers 110. Due to this interface, an interfacial resistance is generated, and thus, each of the conductor connection layers 110 has a large resistance. Meanwhile, the conductor connection layers 110 are connected substantially parallel to the first and second conductors 105 and 106. The resistance required for the heater 104 of the printhead is substantially equal to the total resistance of the conductor connection layers 110. A plan view of the heater 104, including the plurality of conductor connection layers 110 formed between the first and second conductors 105 and 106, is schematically shown in FIG. 3. Here, each of the conductor connection layers 110 has a substantially circular section.

The conductor connection layers 110 may have various shapes, including the shape shown in FIG. 3, and the number of the conductor connection layers 110 may vary with the resistance required for the heater 104. In addition, the conductor connection layers 110 may extend from the first conductor 105, unlike the example shown in FIG. 2.

The second insulating layer 112 is formed between the first and second conductors 105 and 106, so as to fill in-between the conductor connection layers 110. The second insulating layer 112 is used for insulation between the first and second conductors 105 and 106, and insulation between the conductor connection layers 110. The second insulating layer 112 is formed of silicon oxide, like the first insulating layer 102.

A passivation layer 114, for passivating the first and second conductors 105 and 106, is formed on the first and second conductors 105 and 106. The passivation layer 114 prevents the first and second conductors 105 and 106 from oxidizing or directly contacting ink, and can be formed by depositing a silicon nitride layer.

An anti-cavitation layer 118 is formed on the passivation layer 114. The top surface of the anti-cavitation layer 118 forms the bottom surface of an ink chamber 120, thereby preventing the heater 104 from damage due to a high, atmospheric pressure generated when bubbles in the ink chamber 120 are expelled. The anti-cavitation layer 118 can be made of thin-film tantalum (Ta).

A barrier wall 122 is provided on the substrate 100, on which the above-described plurality of material layers are stacked. The barrier wall 122 defines the ink chamber 120 filled with ink to be ejected, and an ink passage (not shown) for supplying ink to the ink chamber 120. That is, the barrier wall 122 forms sidewalls of the ink chamber 120 and the ink passage. The barrier wall 122 is formed by coating a photosensitive polymer on the substrate 100, on which the plurality of material layers are stacked by lamination, including heating, pressing, and squeezing, and by patterning the photosensitive polymer. The coating thickness of the photosensitive polymer depends on the height of the ink chamber 120 required in a volume of ejected ink droplets.

A nozzle plate 132, in which nozzles 130 are formed, is stacked on the barrier wall 122. The nozzle plate 132 is made of polyimide or nickel.

In the above structure, the heater 104, including the plurality of conductor connection layers 110, heats ink filled in the ink chamber 120 due to a current applied by the first and second conductors 105 and 106, and generates bubbles in the ink.

Figure 4:
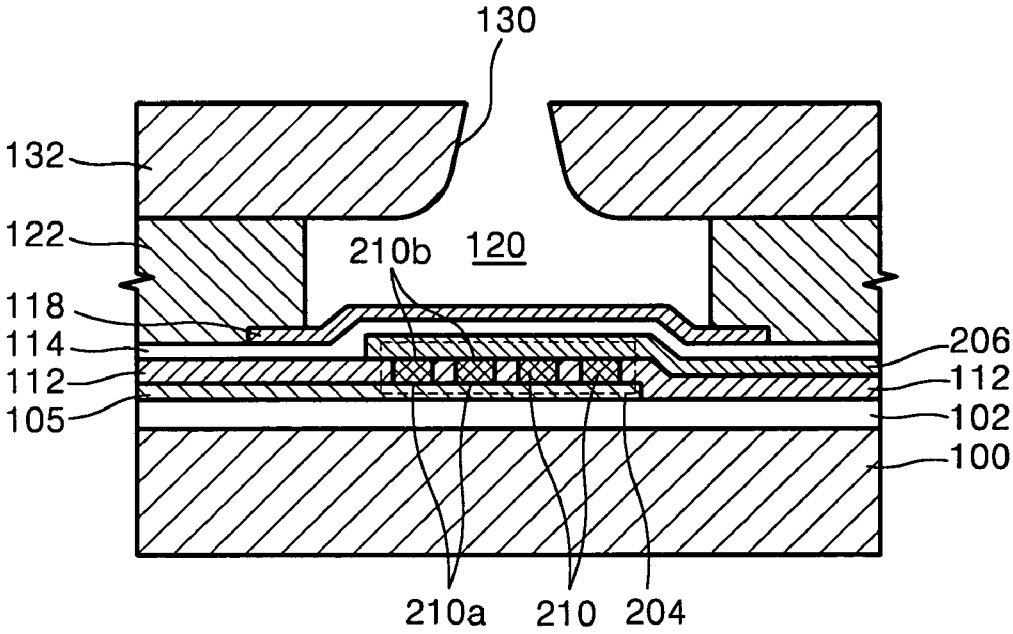
FIG. 4 is a cross-sectional view illustrating a structure of the ink-jet printhead according to another embodiment of the present invention.

FIG. 4 is a cross-sectional view illustrating a structure of the ink-jet printhead according to another embodiment of the present invention. The ink-jet printhead shown in FIG. 4 is similar to the ink-jet printhead shown in FIG. 2, except that conductor connection layers are made of barrier metal. Thus, only differences between FIGS. 2 and 4 will be described below.

Referring to FIG. 4, conductor connection layers 210, connecting a first conductor 105 and a second conductor 206 to each other, are made of barrier metal such as Ti, TiN, Ta, or TaN. Due to the barrier metal, adhesion between the first and second conductors 105 and 206 is improved, the first and second conductors 105 and 206 easily connect to each other, thereby making the conductor connection layers 210 highly-integrated. Meanwhile, an interface is formed in each of first and second connection portions 210*a* and 210*b* where each of the first and second conductors 105 and 206 are connected to the conductor connection layers 210. As such, each of the conductor connection layers 210 has a large resistance. Meanwhile, the conductor connection layers 210 are connected substantially parallel to the first and second conductors 105 and 206. The resistance required for a heater 204 of the printhead is given by the total resistance of the conductor connection layers 210.

As described above, in the ink-jet printhead according to an aspect of the present invention, a heater is formed by connecting conductors with a plurality of conductor connection layers.

Hereinafter, a method for manufacturing the above-described ink-jet printhead will be described.

FIGS. 5A through 5G are cross-sectional views illustrating a method for manufacturing the ink-jet printhead shown in FIG. 2.

Figure 5A:
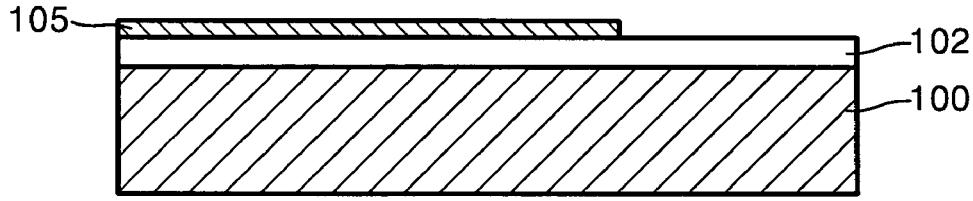
FIGS. 5A through 5G are cross-sectional views illustrating a method for manufacturing the ink-jet printhead shown in FIG. 2.

FIG. 5A illustrates a case where a first insulating layer 102 is formed on the surface of the substrate 100 and a first conductor 105 is then formed on the first conductor 105.

According to an aspect of the present invention, a silicon substrate, having a thickness of substantially between 300–500 μm is used for the substrate 100. A silicon wafer widely used to manufacture semiconductor devices can be used, and thus aid mass production.

A part of the silicon wafer is shown in FIG. 5A. The ink-jet printhead, according to an aspect of the present invention, is manufactured to include a large number i.e., several tens through hundreds, or more, of chips on one wafer.

The first insulating layer 102 is formed on the surface of the silicon substrate 100. The first insulating layer 102 may be a silicon oxide layer formed by oxidizing the surface of the substrate 100 at a high temperature. Alternatively, the first insulating layer 102 may be formed of an insulating material, such as a silicon nitride layer deposited on the substrate 100.

Subsequently, the first conductor 105 is formed on the first insulating layer 102 formed on the surface of the substrate 100. A metallic layer is formed on the first insulating layer 102 by depositing a metallic material having a high conductivity such as aluminum (Al) or aluminum alloy. Subsequently, a photoresist is coated on the surface of the metallic layer, and the photoresist is patterned through photolithography, thereby forming an etch mask. Next, a portion of the metallic layer exposed by the etch mask is removed through dry etch, and the etch mask is removed e.g., by ashing and stripping processes, thereby forming the first conductor 105 shown in FIG. 5A.

Figure 5B:
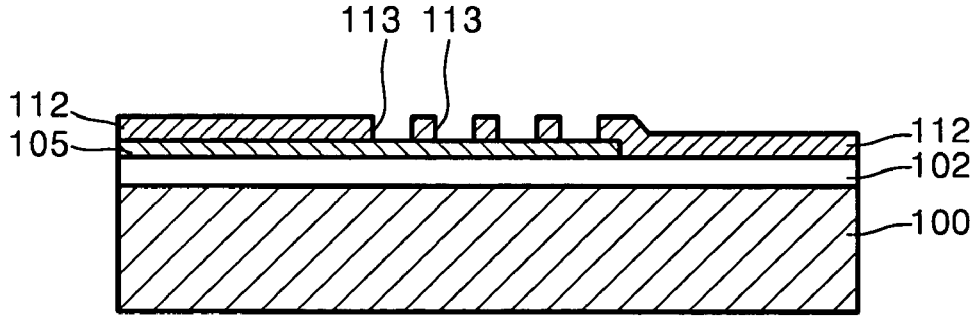

FIG. 5B illustrates the second insulating layer 112 formed on the first insulating layer 102 and the first conductor 105, and then patterned, thereby forming a plurality of via holes 113 through which the first conductor 105 is exposed. The second insulating layer 112, formed of silicon oxide, is formed on the first insulating layer 102, and the first conductor 105. Next, the second insulating layer 112 is patterned by the aforementioned photolithography and dry etch processes, thereby forming the plurality of via holes 113 through which the first conductor 105, on which conductor connection layers (e.g., conductor connection layers 110 of FIG. 2) are to be formed, is exposed.

Figure 5C:
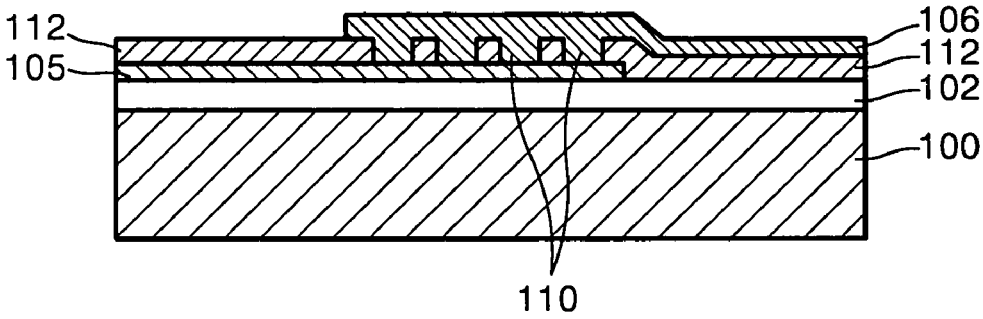

FIG. 5C illustrates the plurality of conductor connection layers 110 and the second conductor 106 formed on the via holes (e.g., via holes 113 of FIG. 5B) and the second insulating layer 112. A metallic layer is formed on the plurality of via holes (113 of FIG. 5B), and the second insulating layer 112, by depositing a metallic material having a good conductivity such as aluminum (Al) or aluminum alloy. Subsequently, the metallic layer is patterned by the aforementioned photolithography and etch processes, thereby forming the plurality of conductor connection layers 110 and the second conductor 106.

Figure 5D:
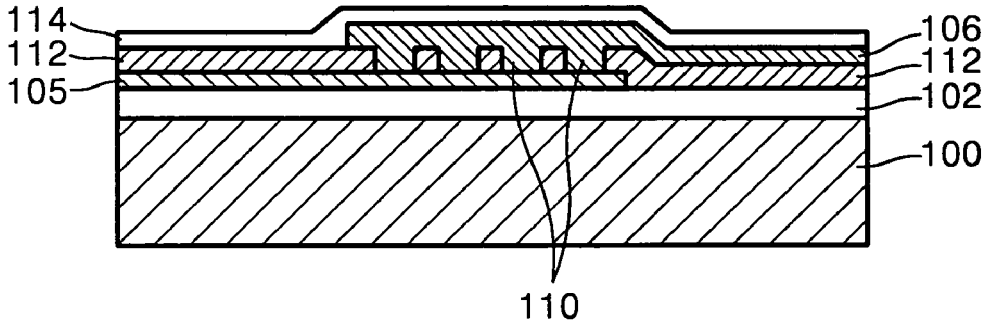

FIG. 5D illustrates the passivation layer 114 formed on the entire surface of the structure shown in FIG. 5C so as to cover the first and second conductors 105 and 206. The passivation layer 114 may be formed by depositing silicon nitride (SiN).

Figure 5E:
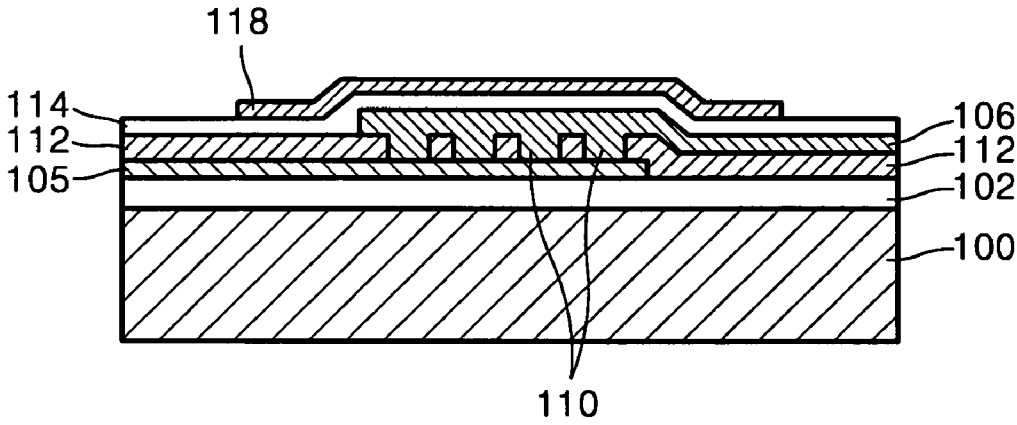

FIG. 5E illustrates the anti-cavitation layer 118 formed on the passivation layer 114. The anti-cavitation layer 118 may be formed by depositing a tantalum thin film on the passivation layer 114 through sputtering and patterning the tantalum thin-film.

Figure 5F:
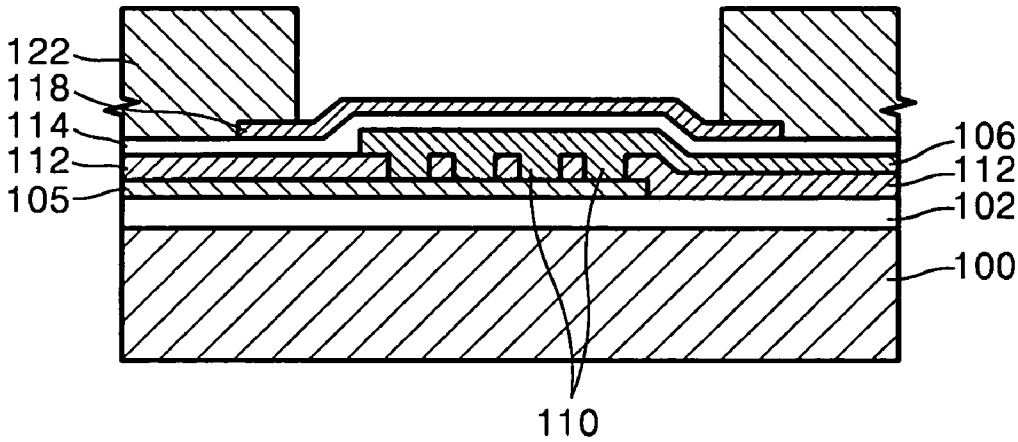

FIG. 5F illustrates the barrier wall 122, defining the ink chamber (120 of FIG. 2), formed on the substrate 200 on which the plurality of material layers are formed. The barrier wall 122 may be formed by coating a photosensitive polymer, for example, polyimide, on the substrate 100 on which the plurality of material layers are formed, to a predetermined thickness, and patterning the polyimide through photolithography. The thickness of the photosensitive polymer depends on the height of the ink chamber (e.g., ink chamber 120 of FIG. 2) required for a volume of ejected ink droplets, and may be different from the exemplified height. The thickness is substantially in the range of 25–35 μm.

Figure 5G:
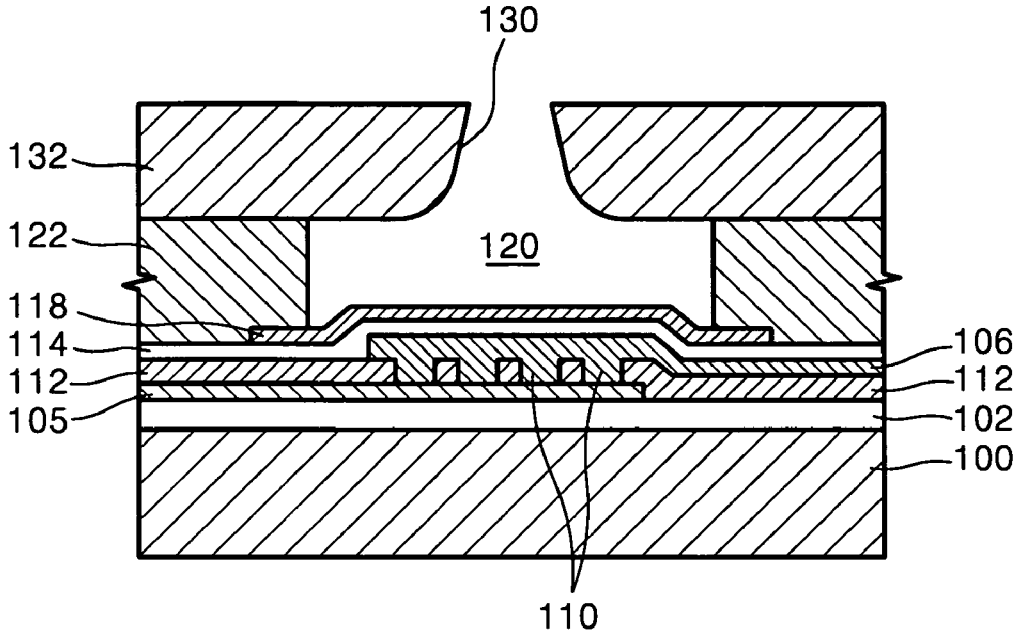

FIG. 5G illustrates the nozzle plate 132, in which the nozzles 130 are formed, is formed on the barrier wall 122. The nozzle plate 132 is made of polyimide, or nickel, and is attached onto the barrier wall 122 using adhesion of the photosensitive polymer forming the barrier wall 122.

FIGS. 6A through 6F are cross-sectional views illustrating a method for manufacturing the ink-jet printhead shown in FIG. 4.

The first insulating layer 102 and the first conductor 105 are formed on the substrate 100, and the second insulating layer 112 and the plurality of via holes (113 of FIG. 5B) are formed on the first insulating layer 102 and the first conductor 105. This is as previously described for FIGS. 5A and 5B.

Figure 6A:
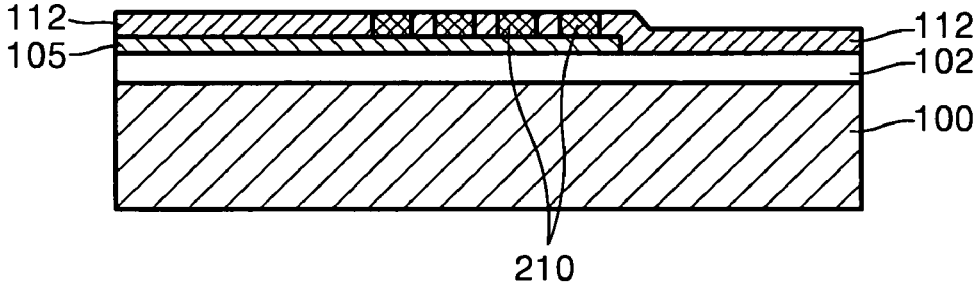
FIGS. 6A through 6F are cross-sectional views illustrating a method for manufacturing the ink-jet printhead shown in FIG. 4.

FIG. 6A illustrates the plurality of conductor connection layers 210 formed on the via holes (via holes 113 of FIG. 5B).

The conductor connection layers 210 are formed by depositing barrier metal, such as Ti, TiN, Ta, or TaN, on the plurality of via holes (113 of FIG. 5B) through which the first conductor 105 is exposed, and dry etching the barrier metal.

Figure 6B:
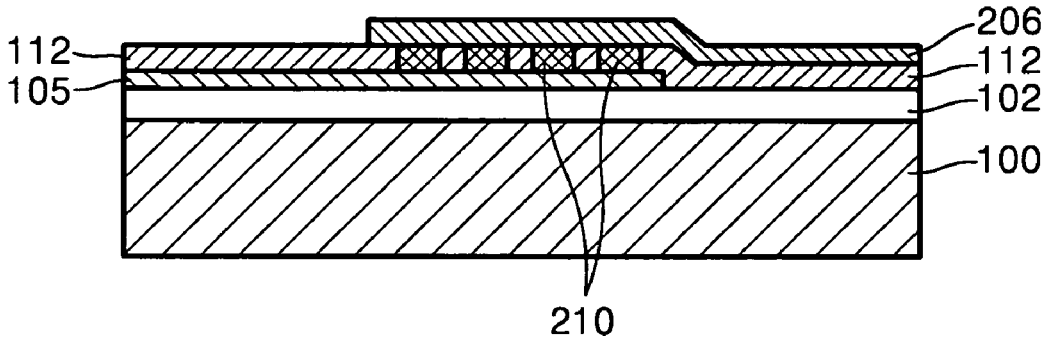
Figure 6C:
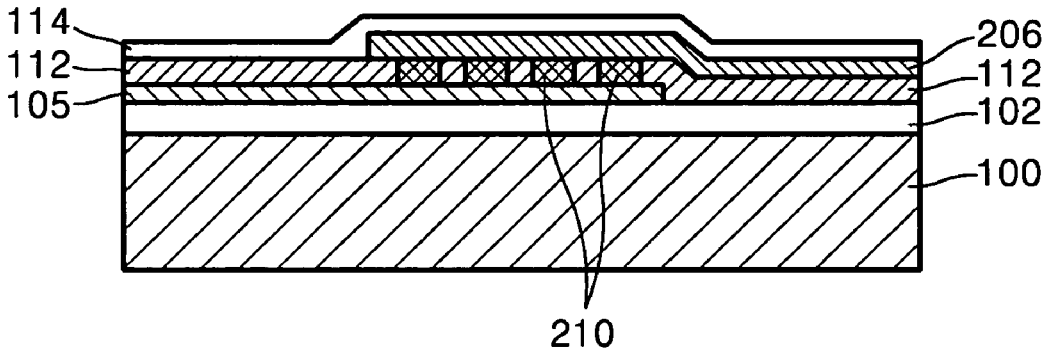
Figure 6D:
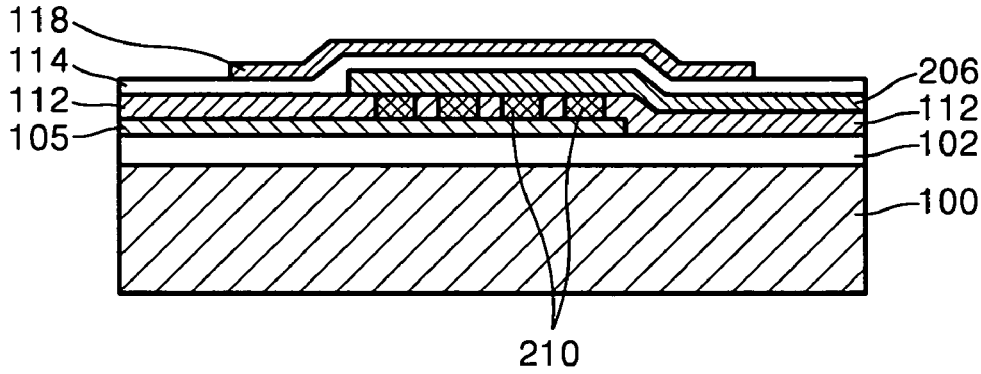
Figure 6E:
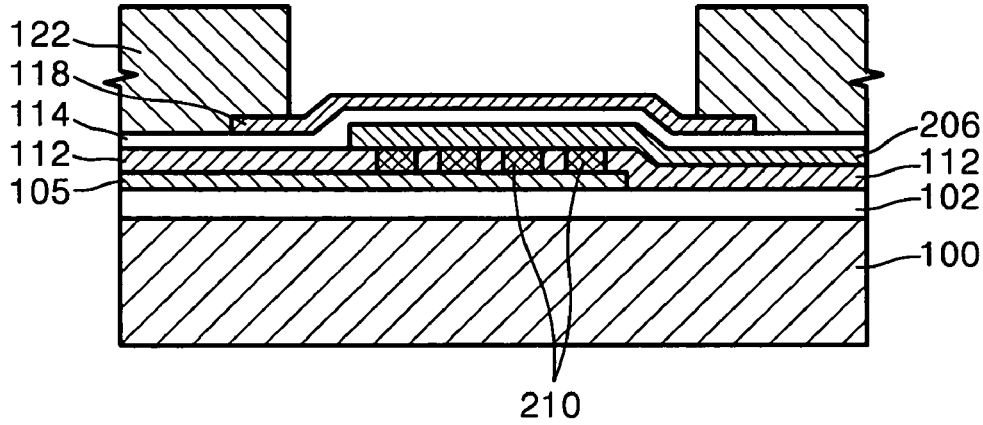
Figure 6F:
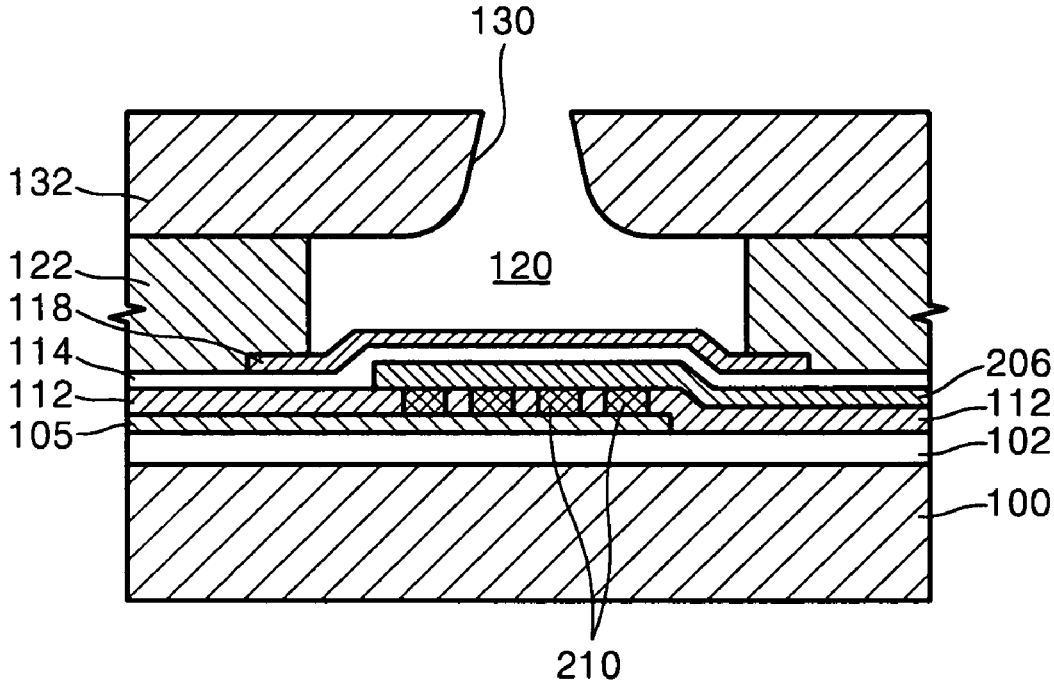

FIG. 6B illustrates the second conductor 206 formed on the top surface of the second insulating layer 112 and the conductor connection layers 210.

The metallic layer is formed by depositing a metallic material, such as aluminum (Al) or aluminum alloy, on the top surface of the second insulating layer 112 and the conductor connection layers 210, and the second conductor 206 is formed by patterning the metallic layer.

The sequence of operations shown in FIGS. 6C through 6F are the same as those shown in FIGS. 5D through 5G, and thus, descriptions thereof will be omitted.

Accordingly, various materials may be used for each element of the ink-jet printhead in aspects of the present invention. In addition, specific values given in the previous examples may be adjusted within ranges in which the manufactured printhead can operate. In addition, the above-described method for depositing and forming each material is merely an example, and various deposition and etch methods may be applied in aspects of the present invention. For example, the features of the present invention of the structure of a heater, and a method for forming the heater, and thus, a barrier wall and a nozzle plate stacked on the heater, may be formed differently from the above-described examples. For example, the nozzle plate may be formed as a single body with the barrier wall using the same material.

As described above, in the ink-jet printhead according to aspects of the present invention, a heater is formed by connecting conductors with a plurality of conductor connection layers such that an additional resistance material need not be provided.

Although a few embodiments of the invention have been shown and described, it would be appreciated by those skilled in the art that changes may be made in these embodiments without departing from the principles and spirit of the invention, the scope of which is defined in the claims and their equivalents.

What is claimed is:

1. An ink-jet printhead comprising:

a substrate;

a first insulating layer on the surface of the substrate;

first and second conductors on the first insulating layer separated from each other;

a heater including a plurality of conductor connection layers electrically connecting the first and second conductors to each other, and between the first and second conductors;

a second insulating layer between the first and second conductors and between the plurality of conductor connection layers;

a barrier wall on the substrate and defining an ink chamber with ink to be ejected; and a nozzle plate on the barrier wall, forming upper walls of the ink chamber and in which nozzles through which ink filled in the ink chamber is ejected are formed.

2. The printhead of claim 1, further comprising an interface in at least one of first and second connection portions connecting each of the first and second conductors connected to the conductor connection layers.

3. The printhead of claim 1, wherein the conductor connection layers extend from one of the first and second conductors.

4. The printhead of claim 1, wherein the conductor connection layers are formed of Ti, TiN, Ta, or TaN.

5. The printhead of claim 1, further comprising a passivation layer on an entire surface of the substrate covering the first and second conductors.

6. The printhead of claim 5, further comprising an anti-cavitation layer on the passivation layer.

7. The printhead according to claim 1, wherein the resistance required for the heater is substantially the total resistance of the conductor connection layers.

8. The printhead according to claim 1, wherein a number of the plurality of conductor connection layers varies with the resistance required for the heater.

9. An ink-jet printhead, comprising:

a substrate;

a plurality of conductors positioned on the substrate; and a plurality of connection layers connecting at least one of the conductors to another conductor, wherein the connected conductors form a heater such that an additional resistance material need not be provided.

10. The ink-jet printhead according to claim 9, further comprising a plurality of insulating layers, wherein a first one of the insulating layers separates the substrate from one of the conductors and serves as an adiabatic layer preventing heat generated in the heater from conducting toward the substrate and a second one of the insulating layers separates one of the conductors from another of the conductors.

11. The ink-jet printhead according to claim 9, wherein the connection layers are made of a barrier metal.

* * * * *